US005435788A

United States Patent [19]

Duff

[11] Patent Number: 5,435,788

[45] **Date of Patent: * Jul. 25, 1995**

[54] CONVERTIBLE, CONVENTIONAL OR BUMPER, BOWLING LANE

[76] Inventor: N. R. Duff, 207 Lafitte Ave., Lafayette, La. 70506

[ * ] Notice: The portion of the term of this patent subsequent to Apr. 19, 2011 has been disclaimed.

[21] Appl. No.: 229,881

[22] Filed: Apr. 19, 1994

Related U.S. Application Data

[63] Continuation-in-part of Ser. No. 5,957, Jan. 19, 1993, Pat. No. 5,304,097.

[51] Int. Cl.[6] ..... A63D 5/00

[52] U.S. Cl. ..... 473/113; 473/55

[58] Field of Search ..... 473/54, 55, 106, 109, 473/113, 116

[56] References Cited

U.S. PATENT DOCUMENTS

| | | | |
|---|---|---|---|
| 3,401,933 | 9/1968 | Conklin et al. | 473/113 |
| 4,792,136 | 12/1988 | Dulisse | 473/113 |
| 5,181,716 | 1/1993 | Stephens | 473/113 |

*Primary Examiner*—V. Millin
*Assistant Examiner*—William M. Pierce
*Attorney, Agent, or Firm*—Joseph L. Lemoine, Jr.

[57] ABSTRACT

An improved bowling lane, which is convertible from a form suitable for conventional bowling to a form suitable for bumper (carom) bowling, includes a series of lane cross-supports, a bowling bed having an approach and foul line at one end and a pin deck at the other end thereof; an elongated concave gutter abutting each side of the bed; an elongated channel within each said gutter disposed parallel to and a distance of less than one-half the diameter of a bowling ball from the edge of said bed; rigid elongated members slidably disposed within each channel; and, means to raise and lower said rigid elongated members.

In the preferred embodiment the improved bowling lane has elongated channels disposed within each gutter, abutting the lateral edges of the bowling bed. Slidably disposed in said channels are rigid elongated members having an upper surface of a matching color and contour of the gutter. In said preferred embodiment, the lower surface of said elements are notched at intersecting cross-supports, on which said elements rest. At least one side of each notch is sloped so that longitudinal movement of said elements, within the elongated channel, causes the elements to slide upward on said cross-supports, into a position suitable for bumper bowling.

4 Claims, 1 Drawing Sheet

CONVERTIBLE, CONVENTIONAL OR BUMPER, BOWLING LANE

This application is a continuation-in-part of application Ser. No. 005,957, filed Jan. 19, 1993, now U.S. Pat. No. 5,304,097.

BACKGROUND OF THE INVENTION

The invention relates to structure of bowling lanes, on which the very popular game of bowling is played. Such lanes typically have cross-member supports, an upper surface which includes an approach and foul line at one end, a bowling bed, a pin zone, and gutters abutting each lateral edge of the bed. The object of the game is to roll a ball from the approach, along the elongated bed, into the pin zone, and knock down as many pins as possible.

In conventional bowling balls laterally misdirected fall into the gutter and cannot knock down any pins. While such "gutter balls" are merely a test of skill to seasoned bowlers, they can be very discouraging to very young persons, elderly persons, novices and disabled persons. Such persons may bowl entire games without knocking down a single pin, become highly discouraged and give up bowling. As these persons may have substantial amounts of leisure time, and may benefit from the exercise of bowling, discouragement of such customers is undesirable. Accordingly, the game of bumper bowling (sometimes called carom bowling, has evolved).

A game of bumper bowling is played similar to conventional bowling (the object remains to knock down pins) except that balls are prevented from entering the gutter, typically by large inflatable cylinders disposed in the gutters or various other complex mechanical apparatus. Such apparatus not only deflects misdirected balls back to the pin zone, but may be intentionally used to redirect the angle at which the ball approaches the pin zone to accomplish "trick shots". Accordingly, bumper bowling is preferred by some persons who have no incapacity to engage in conventional bowling.

The capital cost of bowling lanes being substantial it is highly impractical to build differing sets of lanes, one set exclusively for conventional bowling and another set exclusively for bumper bowling. Rather it is highly desirable to build one set of lanes which is easily convertible at will for either conventional, or for bumper bowling.

Many previous apparatus and/or method to provide such convertible bowling lanes are indurable, complex, expensive, labor intensive, create storage problems and/or aesthetically displeasing.

OBJECTS OF THE INVENTION

The main objects of the invention disclosed herein is to provide an improved bowling lane which may be quickly, inexpensively, convertibly used, either as a conventional bowling lane, or as a bumper (carom) bowling lane.

Another object of the disclosed invention is to provide a means by which an existing bowling lane may be economically modified to a convertible lane.

A further object of the invention is to provide a dual use system which has few movable components, is highly durable and easily repairable.

Yet a further object of the invention is to provide a convertible lane which is unobtrusive to the eye when used in the bumper bowling mode and nearly invisible when in the conventional mode.

SUMMARY OF THE INVENTION

The improved convertible bowling lane is characterized by rigid elongated members slidably disposed within channels, which said channels are parallel to the length of the bowling bed and disposed within the gutters. For conventional bowling said rigid elongated members are retracted into the channel, so that the upper surface of the members are contiguous or below with the concave surface of the gutter. For bumper bowling said rigid elongated members are partially elevated above the channel, so that the upper surface of the members extend above the surface of the bowling bed, thereby forming lateral rails to the bowling bed.

In the preferred embodiment of the invention the rigid elongated members are painted to match the gutter, and have an upper surface contoured to match the concave surface of the gutter.

Also in the preferred embodiment the rigid members have a notched lower surface. The notched portions of the members rest on the bowling lane cross-supports when the members are retracted. The edges of the notches may be tapered so that horizontal movement of the members will cause the members to elevate or retract in the elongated channel.

DESCRIPTION OF THE PREFERRED EMBODIMENT

Figure 1:
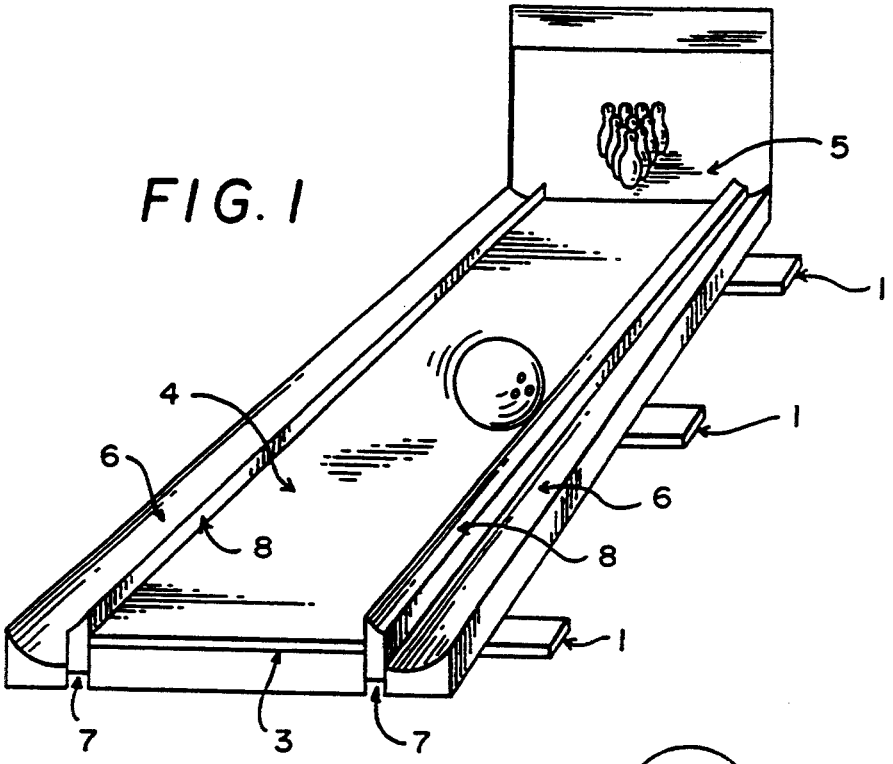
FIG. 1 is a schematical, perspective view of the preferred embodiment of the convertible bowling lane of the invention.

With reference to FIG. 1, the invention herein described includes cross-supports, 1, approach zone, 2, foul line, 3, elongated bowling bed, 4, pin zone, 5, elongated gutters, 6, channels, 7, and rigid member, 8. Cross-members, 1, typically of wooden beam construction, are disposed perpendicular to the direction of the lane, at sufficient intervals to support the weight of the lane and equipment thereon. The bowling lane surface includes approach zone, 2, elongated bowling bed, 4, and pin zone, 5. These components are typically of wooden construction, usually of elongated strips of wood glued together under high pressure, running lengthwise to the direction of ball travel. Typically the approach zone, the pin zone, and a portion of the bowling bed contiguous to each of these zones, is made of a hard wood which is highly durable surface to impacts. The intermediate section of the bowling bed (on which balls and pins are rarely dropped) may be made of a softer wood.

Figure 2:
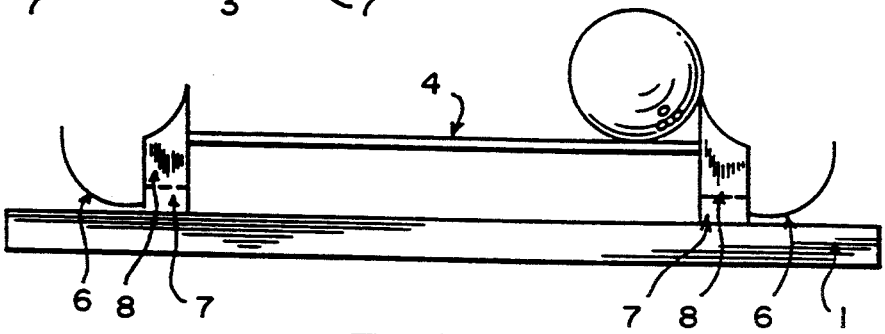
FIG. 2 is a schematical, elevation view of the rigid elongated member of the preferred embodiment of the invention.

With additional reference to FIG. 2, lateral to each side of the elongated bowling bed and pin zone are concave gutters, 6. Said gutters are typically fabricated of laminated wood construction, pressed into a concave shape, and, are generally commercially available in sections of specified length (usually 10 foot lengths). Disposed longitudinally within each gutter is channel, 7. Channel, 7, is typically formed by simply sawing out a narrow (usually about 1½"), elongate (usually the full length of the bowling bed) section of the gutter. In the preferred embodiment said channel is disposed contiguous with the edges of the bowling bed, but may be located more laterally to the bowling bed if desired (providing the distance from the edge of the bowling bed to the nearest edge of the channel is less than the radius of the smallest ball to be used on the lane).

Disposed in channel, 7, is rigid member, 8. Rigid member, 8, is typically made of wooden beams such as "two by fours", but many other rigid, durable materials would work equally as well. In practice rigid member, 8, may consist of one beam or may include several sections in end-to-end relationship.

Figure 3:
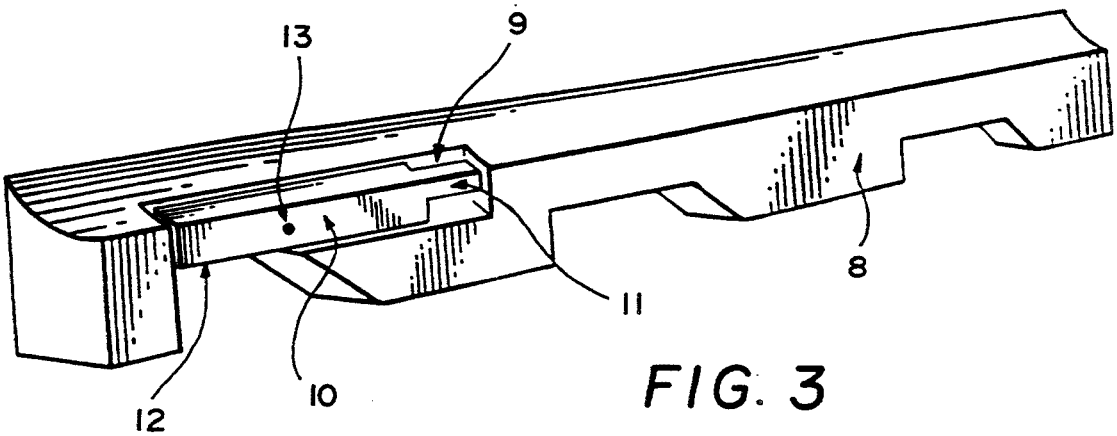
FIG. 3 is a schematical, cross-sectional view of the preferred embodiment of the invention.

With additional reference to FIG. 3, in the preferred embodiment the upper surface of rigid member, 8, is shaped to form a continuous, flush contour with the surface of gutter, 6, when recessed within channel, 7. The lower surface of rigid member, 8, is notched at the intersections of cross-supports, 1, therewith. In said embodiment at least one side of each notch has a tapering or sloped configuration, so that longitudinal movement (by manual or powered means) of the rigid member, 8, will cause it to slide upward upon cross-member, 1, elevating an upper portion of rigid member, 8, above the level of the bowling bed, 4. When so fully elevated the unnotched portions of rigid member, 8, rest on cross-member, 1.

In the preferred embodiment, the lane can be easily converted to a bumper configuration using rigid lever, 10. In this embodiment, rigid member, 8, contains recessed groove, 9,on its upper surface. Rigid lever, 10, which has handle section, 11, and base edge, 12, is pivotably disposed within recessed groove 9. Application of upward force to handle section, 11, causes rigid lever, 10, to pivot, thereby contacting base edge, 12, with the foundation beneath the bowling alley. Continued application of upward force on handle, 12, of lever, 10, results in longitudnal movement of rigid member, 8, causing it to slide upward upon cross-member, 1, and elevate an upper portion of rigid member, 8, above the level of the bowling bed, 4. The upper surface of rigid lever, 10, can be shaped to form a continuous, flush contour with the surface of rigid member, 8, and gutter, 6, when rigid member, 8, is recessed within channel, 7. However, this is not required; rigid lever, 10, must simply be of sufficient size to completely fit within recessed groove, 9, so that it does not impede the travel of any bowling balls rolled into gutter, 6.

Alternatively, rigid member, 8, may be elevated vertically, without longitudinal movement, by either manual or powered means. When so raised it may be necessary to shift the rigid member longitudinally (so its unnotched portions rest on cross-members and the rig member remains elevated) or, the member may be pinned or locked in an elevated position by manual or powered means.

The described invention is simple and easy to use. When the lane is to be used for conventional bowling rigid members, 8, are retracted into channel, 7, and form a continuous surface with gutter, 6. When painted to match gutter, 6, the retracted members are nearly invisible to the eye. When the lane is to be used for bumper bowling, rigid members, 8, are elevated so that an upper portion thereof is above the surface of the bowling bed, 4, thereby constituting "bumper rails" thereto. In the preferred embodiment rigid members, 8, abuts the edges of the bowling bed, 4. So disposed it is necessary to elevate rigid member, 8, only about 1½" to form an effective "bumper rail". When painted to match the color of the gutter, even elevated rails are unobtrusive to the eye. Therefore, persons engaging in bumper bowling tend to feel less embarrassed for not engaging in "real bowling" because of any incapacities they may have.

The above described embodiments should be regarded as only illustrative of the invention, of which many embodiments within the scope and spirit of the invention may be described.

What is claimed is:

1. An improved bowling lane, convertible for use in either conventional bowling or bumper bowling, comprising:

a) an upper surface comprising an approach zone, a foul line, an elongated bowling bed having a lateral edge on each side, and a pin zone having a lateral edge on each side;

b) a plurality of underlying cross-members disposed perpendicularly to and supporting the elongated bowling bed;

c) an elongated, concave gutter disposed parallel to and abutting each lateral edge of said bowling bed and the pin zone;

d) a hollowed, elongated channel, disposed within each gutter, parallel to the lateral edges of the bowling bed, at a distance from the nearest edge of the bed which is less than the radius of a smallest bowling ball to be used on the improved bowling lane;

e) elongated rigid rail members slidably disposed within each said channel wherein each rigid rail member has a plurality of lower surfaces inclined in a direction perpendicular to the underlying cross-members which said surfaces slidably override the underlying cross-members to raise or lower the rigid rail members vertically, in a cam-follower fashion, responsive to longitudinal movement of the rigid rail members within the elongated channels.

2. An improved bowling lane, convertible for use in either conventional bowling or bumper bowling, comprising:

a) an upper surface comprising an approach zone, a foul line, an elongated bowling bed having a lateral edge on each side, and a pin zone having a lateral edge on each side;

b) a plurality of underlying cross-members disposed perpendicularly to and supporting the elongated bowling bed;

c) an elongated, concave gutter disposed parallel to and abutting each lateral edge of said bowling bed and the pin zone;

d) a hollowed, elongated channel, disposed within each gutter, parallel to the lateral edges of the bowling bed, at a distance from the nearest edge of the bed which is less than the radius of a smallest bowling ball to be used on the improved bowling lane;

e) elongated rigid rail members slidably disposed within each said channel wherein each rigid rail member has a plurality of inclined lower surfaces which said surfaces slidably override the underlying cross-members to raise or lower the rigid rail members vertically, in a cam-follower fashion, responsive to longitudinal movement of the rigid rail members within the elongated channels; and, f) means for applying longitudinal force to said elongated rigid rail members comprising a lever pivotably disposed within a recessed portion of each said elongated rigid rail member, said lever having a pivot axis parallel to the underlying cross-support members.

3. An improved bowling lane convertible for use in either conventional bowling or bumper bowling, comprising:

a) an upper surface comprising an approach zone, a foul line, an elongated bowling bed having a lateral edge on each side, and a pin zone having a lateral edge on each side;

b) a plurality of underlying cross-members disposed perpendicularly to and supporting the elongated bowling bed;

c) an elongated, concave gutter disposed parallel to and abutting each lateral edge of said bowling bed and the pin zone;

d) a hollowed, elongated channel, disposed within each gutter, parallel to the lateral edges of the bowling bed, at a distance from the nearest edge of the bed which is less than the radius of a smallest bowling ball to be used on the improved bowling lane;

e) elongated rigid rail members, slidably disposed within each said channel, wherein said elongated rigid rail members have a lower surface comprised of a plurality of notched sections, a plurality of unnotched sections, and a plurality of inclined sections disposed between said notched sections and said unnotched sections, wherein said notched sections rest on the underlying cross-members when the rigid rail members are in a lowered position, said unnotched sections rest on the underlying cross-members when the rigid rail members are in an elevated position and said inclined sections slidably override the underlying cross-members to elevate or lower the rigid rail member, in cam-follower fashion, responsive to longitudinal movement of the rigid rail member within the elongated channels; and, f) means for applying longitudinal force to said elongated rigid rail members comprising a lever pivotally disposed within a recessed portion of each said elongated rigid rail member, said lever having a pivot axis parallel to the underlying cross-support members.

4. An improved bumper rail for use in combination with a bumper bowling alley having longitudinally disposed channels of the gutters which extend through to underlying cross-member supports, for slidable installation of said improved bumper rails into said channels and onto said cross-member supports, wherein each improved bumper rail is comprised of a longitudinally extended rail member comprising:

a) a concave upper surface conforming to the curvature of a gutter in which the rail is to be installed;

b) substantially vertical side surfaces;

c) a lower surface comprising a plurality of notched sections, a plurality of unnotched sections and a plurality of inclined sections disposed between said notched and said unnotched sections, wherein said notched sections are spaced so as to rest on an underlying cross-support member when the upper surface of the rail is contiguous with the curvature of a gutter in which the rail is to be installed, wherein said unnotched sections are spaced apart so as to rest on an underlying cross-support member when the upper surface of the rail is elevated a desired amount above the surface of the gutter in which the rail is to be installed, and, wherein said inclined sections slidably override the underlying cross-member supports to raise or lower the rail, in a cam-follower fashion, responsive to longitudinal movement of the rail within a channel disposed in a gutter in which the rail is to be installed; and, d) means for applying longitudinal force to said extended rail members comprising a lever pivotally disposed within a recessed portion of each said extended rail member, said lever having a pivot axis parallel to the underlying cross-support members.

* * * * *